United States Patent [19]

Touro

[11] Patent Number: 4,605,537

[45] Date of Patent: Aug. 12, 1986

[54] SULFIDE AS A HYPOCHLORITE KILL AGENT

[75] Inventor: Freddie J. Touro, New Orleans, La.

[73] Assignee: Freeport Minerals Company, New York, N.Y.

[21] Appl. No.: 651,087

[22] Filed: Sep. 17, 1984

[51] Int. Cl.[4] ..... B01D 11/00

[52] U.S. Cl. ..... 423/29; 423/22; 423/34; 423/38; 423/424; 423/473; 423/474; 423/499; 75/101 R; 75/105; 75/108; 75/114; 75/118 R

[58] Field of Search ..... 423/38, 473, 474, 499, 423/424, 34, 29, 46, 22; 75/101 R, 105, 108, 118 R, 114

[56] References Cited

U.S. PATENT DOCUMENTS

| | | | |
|---|---|---|---|
| 2,784,057 | 3/1957 | Chisnall | 423/499 |
| 3,639,925 | 2/1972 | Scheiner et al. | 75/105 |
| 4,259,107 | 3/1981 | Guay | 75/118 R |
| 4,289,532 | 9/1981 | Matson et al. | 75/118 R |
| 4,307,067 | 12/1981 | Tagawa et al. | 423/224 |

*Primary Examiner*—John Doll
*Assistant Examiner*—Robert L. Stoll
*Attorney, Agent, or Firm*—Fisher, Christen & Sabol

[57] ABSTRACT

Residual hypochlorite contained in chlorinated slurries of either carbonaceous gold-containing ores or mixtures of carbonaceous and oxide gold-containing ores are reduced by reaction with sulfide ion-providing chemical compounds preferably sodium hydrosulfide, sodium sulfide or hydrogen sulfide. The hypochlorite "kill" step enables subsequent cyanide leach operations to be conducted more efficiently.

18 Claims, 1 Drawing Figure

SULFIDE AS A HYPOCHLORITE KILL AGENT

BACKGROUND OF THE INVENTION

1. Field of the Invention

This invention relates to the use of sulfide ion-providing chemical compounds in gold ore slurries to react with or "kill" residual hypochlorite ions resulting from gold ore slurry chlorination steps. More particularly this invention relates to the use of sodium hydrosulfide (NaHS), sodium sulfide ($Na_2S$) and hydrogen sulfide ($H_2S$) in processes which recover gold from carbonaceous ores or mixtures of carbonaceous and oxide ores by use of a chlorination step to oxidize continued carbonaceous material and render it incapable of absorbing or complexing with the gold during subsequent cyanidation.

2. The Prior Art

Two general types of gold-containing ores are commonly encountered in gold recovery operations. These types are oxide ores, from which gold or other precious metals are easily extracted by cyanidation techniques, and carbonaceous ores, which contain indigenous organic carbon material and are notoriously refractory to standard cyanidation techniques. Gold-containing carbonaceous ores normally comprise between 0.25 and 3% by weight of carbon. The carbonaceous material in these ores include active carbon and long chain organic compounds. During cyanide leaching processes, carbonaceous materials adsorb gold cyanide complexes [$Au(CN)_2$—]. The long chain carbon compounds form stable complexes with the gold compounds.

Carbonaceous gold-containing ores are found widely in the United States and in other countries throughout the world. In some instances, carbonaceous ores can be found absent oxide ores, however, the usual case is that mixtures of carbonaceous ores and oxide ores are found together. The fraction of oxide ore in the mixtures of carbonaceous and oxide ores can vary, but such mixtures usually contain up to 70% oxide ore. A characteristic of the ore mixtures is that they are not amenable, because of their carbonaceous ore content, to standard cyanidation techniques. In such cases less than about 50% gold extraction is obtainable from such ore mixtures when they are treated by conventional straight cyanidation methods. For this reason, it is usually more efficient to process the ore mixtures as if they were composed entirely of carbonaceous ore. Ore mixtures containing significant quantities of carbonaceous ore for purposes of this invention are included within the term "carbonaceous ores".

The carbonaceous ores are not amenable to standard cyanidation techniques because the carbonaceous impurities tend to "tie up" the cyanide gold complexes. Research into means of recovering gold from the carbonaceous ores has led to the development of processes utilizing chemical oxidation to render the ores more amenable to cyanidation steps. Oxidation is accomplished by oxygenation with air or other oxygen containing gas, or chlorination with gaseous chlorine, sodium hypochlorite or calcium hypochlorite. The hypochlorites are most effective and yield their best results between about 80° F. to about 120° F.

The above described oxidation processes are usually conducted with the ore slurried in water. A cyanide leach step then follows the oxidation step. When oxidation is accomplished with a chlorine-containing compound, a residual concentration of hypochlorite ions (OCl—) are usually present in the ore slurry at the completion of the chlorination step. Even if chlorine gas were used in the chlorination step, the residual chlorine-containing ion is in the form of hypochlorite ions. This is true because, at the normally prevailing slurry pH values during this point in the process, chlorine gas is rapidly converted to hypochlorite ions as it is dissolved.

Prior art techniques do not include chemical addition to effect removal or reduction of the concentration of hypochlorite ions in the slurry prior to the slurry entering the cyanide leach circuit. Instead, they require long periods in which the hypochlorite ions are allowed to decompose in holding tanks. A requirement in a process for a holding tank greatly adds to the capital expenditure in plant equipment to conduct the process. The techniques of the prior art are, therefore, unnecessarily expensive because they require increased time to process these slurries and additional equipment. The removal of these ions is important because hypochlorite ions react with cyanide ions. This reaction, if allowed to occur, increases the quantity of cyanide compounds required for the reaction and, under certain conditions, can produce undesirable reaction products.

One well-known gold extraction process involving an oxygenation and/or chlorination step prior to a cyanidation leach step is delineated in U.S. Pat. No. 4,289,532 to Matson. The process of this patent utilizes oxygenation and/or chlorination to effect oxidation of carbonaceous material contained in gold-containing ores. When chlorine compounds are used, the process of this patent calls for the ore slurry to be held in a holding tank for 2–3 hours to allow excess hypochlorite to be consumed prior to the ore slurry entering the cyanide leach step. The length of time required to hold the slurry depends on the refractory nature of the ores treated and the amount of chlorine used. The required hold time to eliminate hypochlorite can be decreased by elevating the ore slurry temperature to and maintaining it above about 120° F. Hypochlorite decompose rapidly above this temperature. The cost of heating the slurry to over 120° F. is substantial, especially during cold weather.

Chlorination of carbonaceous gold-containing ore slurries is an effective means of pretreating the ore slurries for subsequent cyanide leaching. The concentration of residual hypochlorite ions described above must be consumed or reduced to very low levels prior to the slurry entering the cyanide leach circuit. Without such removal the hypochlorite ions react with cyanide ions and render the cyanide ions ineffective for gold leaching. It can be seen that a method of rapidly and efficiently consuming excess hypochlorite in chlorinated gold ore slurries would be economically beneficial because the requirement for holding tanks is eliminated and the time to conduct the process is significantly reduced. It is therefore an object of this invention to provide a means of rapidly reducing residual hypochlorite ion concentrations existing in carbonaceous gold ore slurries after oxidation of the carbonaceous materials in the slurries with chlorine compounds. By achieving this objective this invention improves the efficiency of cyanide leach operations on chlorinated gold ore slurries by reducing the concentration of hypochlorite ions entering the cyanide leach step. Other objectives of this invention are to eliminate or reduce the size of holding tanks used in the process and provide an energy savings by eliminating the requirement to elevate the slurry temperature, for decomposition of hypochlorite.

SUMMARY OF THE INVENTION

The invention includes a method to reduce a level of residual hypochlorite ion concentrations in a chlorinated slurry of a carbonaceous ore. The preferred embodiment of this invention is for use with carbonaceous gold-containing ore. Carbonaceous gold-containing ore also includes mixtures of carbonaceous gold-containing ore with an oxide gold-containing ore. The chlorinated slurry is reacted with a sulfide ion-providing compound which reduces the residual hypochlorite in the chlorinated slurry.

The consumption of excess residual hypochlorite in chlorinated carbonaceous ore slurries is accomplished in accordance with this invention by chemically reacting the hypochlorite ions with a sulfide ion-providing chemical compound such as sodium sulfide ($Na_2S$), hydrogen sulfide ($H_2S$), or sodium hydrosulfide (NaHS). With adequate mixing, the reaction between the selected sulfide compound and the hypochlorite can be completed within several minutes.

In the preferred embodiment of the invented method, the hypochlorite-containing ore slurry is transferred from the chlorination step to a reaction vessel where it is mixed with the selected sulfide compound. Following the consumption of the excess hypochlorite, the "neutralized" slurry is then passed to the cyanide leach step.

Since the chemical reaction between the sulfide ions and the hypochlorite ions is very rapid, an alternate method of mixing the selected sulfide compound with the chlorinated slurry is achieved by injecting the sulfide directly into a pipeline used to transfer the slurry from the chlorination step to the cyanide leach step, thereby avoiding the need for separate reaction vessels or holding tanks.

DETAILED DESCRIPTION

Figure 1:
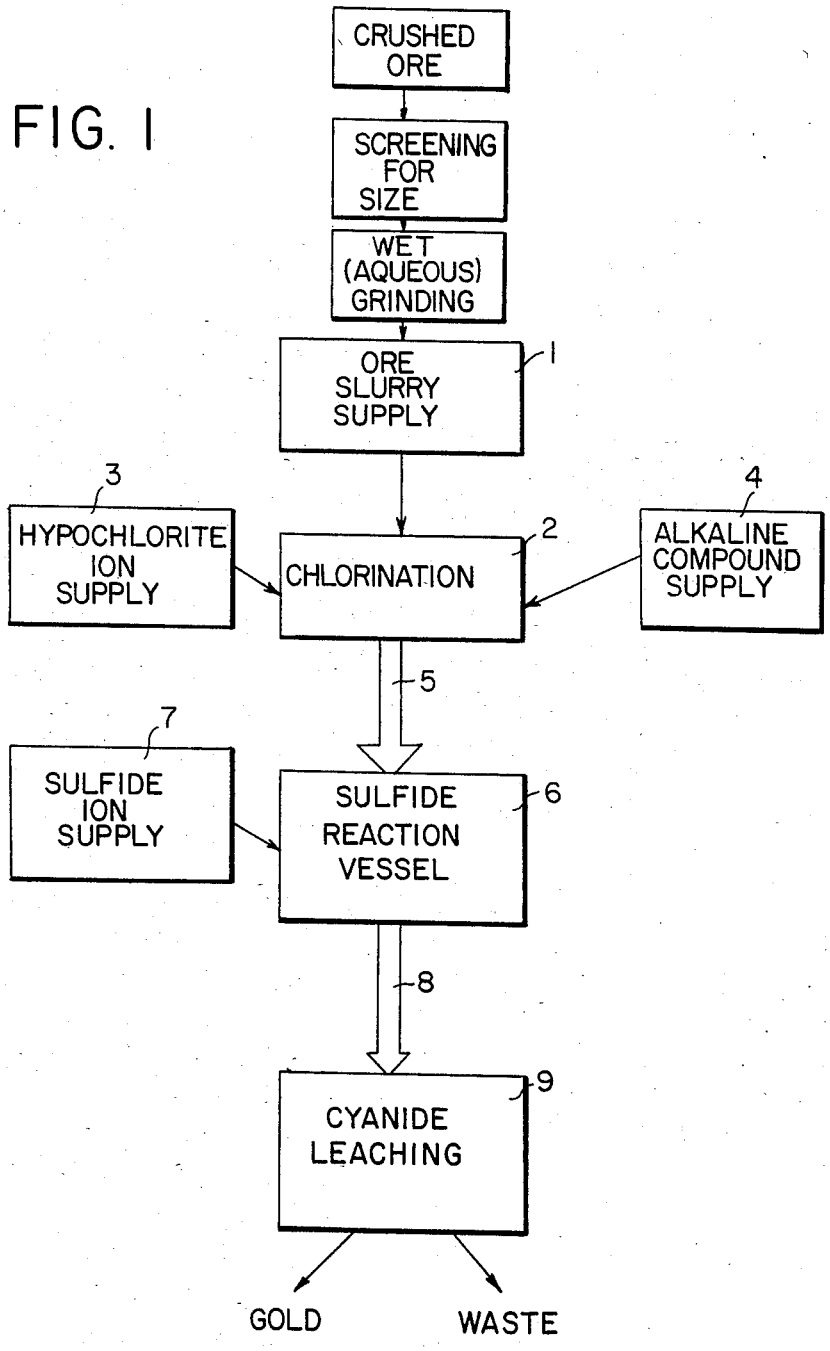
FIG. 1 is a flow diagram illustrating the preferred embodiment of the invented method in which addition of the sulfide containing compound is made to a reaction tank in the process between the chlorination step and the cyanide leach step.

FIG. 1 illustrates the basic steps involved in a process for recovering gold from carbonaceous ore. The ore after mining is crushed and wet ground. The ground ore then enters an oxygenation step. An oxygenation step is not present in all gold recovery processes from carbonaceous ores. An oxygenation step is most useful when processing a highly refractory ore. With these ores a preliminary oxygenation step reduces the total quantity of chlorine required later in the process and thereby makes the overall process more economical. Where, for example, there is a low or medium refractory ore the oxygenation step may be completely absent from the recovery process. The carbonaceous ore slurry 1 with a solids content of between about 40% to about 60% and preferably about 50% by weight is ready for further processing.

The slurry 1 is fed to a tank or vessel to undergo a chlorination step 2. Chlorination is usually preformed with agitation of the slurry 1 in one or more vessels. A hypochlorite supply 3 provides for injection into the slurry 1 of chlorine gas, sodium hypochlorite, or any other suitable source of hypochlorite ion. The amount of hypochlorite, expressed as NaOCl, added in this process is usually between about 15 to about 150 pounds per ton of dry ore. The exact quantity of hypochlorite required depends largely on the type of ore being processed. Chlorination is conducted for at least one hour and preferably between 1 to 6 hours at temperatures ranging from between about 80° F. to about 120° F.

The pH of the slurry during chlorination tends to drop as the reaction advances. To enhance the chlorination of the ore it is desirable to maintain a pH above about 5. An alkaline material can be added prior to or during the chlorination step. Soda ash ($Na_2CO_3$) is an example of an alkaline agent which can be economically used to increase the pH of the slurry and help drive the reaction.

The chlorinated ore slurry exits the chlorination step 2 usually through a transfer line 5. In most cases the slurry is then fed to a sulfide reaction tank 6. It is preferred that a method to agitate the slurry is provided in the sulfide reaction vessel 6. The residual hypochlorite concentration at this stage of the reaction varies widely depending on the ore characteristics, the chlorination rate, and the slurry temperatures. The residual hypochlorite concentration will usually range between about 0.5 to about 5.0 grams, expressed as NaOCl, per liter of slurry. A solution of a sulfide-providing compound from sulfide supply 7 is mixed into the slurry in the sulfide reaction vessel 6. The agitation within the vessel 6 enhances the reaction time between the sulfide compound and the hypochlorite. Usually only several minutes of contact time with adequate mixing is enough to complete the reaction. the sulfide reaction time is so rapid that the sulfide reaction vessel 6 can be much smaller and less expensive then the hold tanks used in the prior art. The rapidity of this reaction is such that the supply line 5, if it is long and the travel of the slurry through it is slow, it is sufficient to act as a sulfide reaction vessel and completely eliminates the need for the sulfide reaction vessel.

After the sulfide-hypochlorite reaction is complete the hypochlorite-free slurry is removed from the sulfide reaction vessel 6 through transfer line 8. The slurry is deposited into a cyanide leaching apparatus 9. After the cyanidation step, the gold-containing fraction is removed for further processing and purification while the gold-barren fraction is sent to waste. FIG. 1 outlines a process for recovering gold from carbonaceous ores which is useful with this invention, but the particular methods of chlorination and alkaline addition are not critical to this invention. Additional details on carbonaceous ore chlorination and alkalination methods can be found in U.S. Pat. No. 4,289,532 to Matson, which is hereby incorporated by reference.

An alternative embodiment of the above process is one in which the hypochlorite containing slurry is first retained in holding vessels until a substantial part of the hypochlorite has decomposed via natural means. The residual hypochlorite would then be eliminated via the preferred process previously described. Some savings of sulfide compounds would result. For a new gold extraction facility, however, the cost of obtaining a holding tank and the cost of transferring the slurry through the additional holding step can be prohibitive to the use of this alternative and justify the use of the preferred process where sufficient sulfide compounds are used to completely consume excess hypochlorite.

The amount of sulfide compound required to react with the hypochlorite varies considerably from the calculated stoichiometric amount as the slurry hypochlorite concentration varies. At relatively high slurry hypochlorite concentrations, the amount of sulfide compounds required is about or slightly in excess of the calculated stoichiometric amount. At lower hypochlorite concentrations, however, the amount of sulfide compounds required exceeds the stoichiometric amount by an appreciable margin. For the average range of hypochlorite concentrations encountered in the industry, i.e., hypochlorite concentrations of 0.5 to 5.0 grams per liter (0.0067 to 0.0670 moles per liter), expressed as NaOCl, the ratio of sulfide chemical addition is usually from 1.0 to 3.0 times the calculated stoichiometric amount required to react with and completely consume the hypochlorite.

Numerous sulfide ion providing compounds can be used to react with the excess hypochlorite ions to carry out this invention. Three sulfide reactants are preferred because of their economic practicality and commercial availability. These sulfide compounds are hydrogen sulfide, sodium hydrosulfide, and sodium sulfide. Of these, sodium hydrosulfide has certain advantages over the other two. Sodium hydrosulfide is available commercially as a concentrated liquid (45% NaHS) making it easier to control in forming solutions for addition from the sulfide supply system to the slurry. Sodium sulfide is normally available commercially as a solid. To use this compound it must first be dissolved which usually requires some agitation and mixing in the sulfide supply apparatus before it can be injected into the slurry. Hydrogen sulfide, though widely used in industry and effective in this invention, is potentially a safety and environmental hazard because it is a poisonous gas. Hydrogen sulfide upon reacting with sodium hypochlorite produces sulfuric acid and increases the need for alkaline material to be added to control the slurry pH.

The chemical reactions taking place for each of the preferred sulfide compounds are:

$$H_2S + 4NaOCl \rightarrow H_2SO_4 + 4NaCl$$

$$Na_2S + 4NaOCl \rightarrow Na_2SO_4 + 4NaCl$$

$$NaHS + 4NaOCl \rightarrow NaHSO_4 + 4NaCl$$

In the above equations, and throughout this disclosure, the hypochlorite ion containing molecule is expressed as sodium hypochlorite.

A feed system apparatus for supplying the sulfide ion-providing compounds to the gold recovery system works in combination with that system and varies according to the compound used. For example, a sulfide supply apparatus for concentrated liquid sodium hydrosulfide requires very little agitation to form a sulfide compound solution which can be injected into either the transfer line 5 or the sulfide reaction vessel 6. An apparatus to supply sodium sulfide preferably requires a means to agitate the solid and facilitate its dissolution. The use of hydrogen sulfide would also require a gas injection system. In conjunction with the apparatus for dissolving the sulfide compounds various means to monitor and control the stoichiometric injection rate of these compounds, such as computers and computer control drive mechanisms to operate valves, can be used.

The invention is most effective when the slurry pH is between about 5 and about 10. The preferred pH range is between about 5 and about 7. The slurry temperature for this invention can range between about 32° F. to about 120° F., however, the preferred temperature range is between about 80° F. to about 120° F. Above 120° F., hypochlorite decomposes and dissipates rapidly. Lower temperatures decrease the rate of the reaction.

The following examples are actual tests performed on carbonaceous gold bearing ore samples and further illustrate the invented method.

EXAMPLE 1

A 3 liter test ore slurry comprising 50% solids was prepared by slurrying in an agitated laboratory stainless steel beaker, 2200 grams of fresh tap water and 2200 grams of carbonaceous gold ore ground to 95%-100 mesh. The raw ore contained 0.29% organic carbon. Such an ore is considered slightly carbonaceous.

The above test ore slurry was subjected to a chlorination treatment similar to the chlorination treatment often used in full scale processing of carbonaceous gold ores. Gaseous chlorine contained in pressurized cylinders was injected into the slurry at a point near the bottom of the beaker. Standard laboratory dispersion tubes were used to inject the chlorine gas into the slurry which was maintained in an agitated state by a T-Line lab stirrer rotating at about 100 rpm. Chlorination at the average rate of about 160 $cm^3$/min continued for 6 hours. A sample was then removed from the slurry and analyzed for hypochlorite concentration via the standard iodine-sodium thiosulfate technique. Next a 600 milliliter slurry sample was taken and the amount of $Na_2S$ required to completely consume the hypochlorite was determined by titrating the slurry sample with a 50 grams per liter solution of the $Na_2S$ while simultaneously monitoring the oxidation potential of the slurry sample. The results of the test follows.

Residual NaOCl concentration in slurry at completion of chlorination step (moles/liter of slurry)—0.068

Residual NaOCl concentration in slurry after neutralization with $Na_2S$ (moles/liter of slurry)—0

$Na_2S$—stoichiometric requirements for complete NaOCl neutralization (moles/liter of slurry)—0.017

$Na_2S$ used to neutralize NaOCl residual (moles/liter of slurry)—0.032

Multiple of stoichiometric amount of $Na_2S$ required to neutralize NaOCl residual—1.9

EXAMPLE 2

A more carbonaceous ore than the ore of Example 1 was used in Example 2. The organic carbon content of the ore was 0.503% which is high enough for the ore to be considered a moderately carbonaceous ore.

The procedure used in this example was similar to that of Example 1, the exceptions being that the test ore slurry of Example 2 had a lower solids content (i.e. 44%) the $Na_2S$ titrating solution of Example 2 had twice the strength (i.e. 100 gm/l $Na_2S$) and the volume (300 ml) of the slurry sample titrated of Example 2 was one half that of Example 1. The results of the test follows:

Residual NaOCl concentration in slurry at completion of chlorination step (moles/liter of slurry)—0.020

Residual NaOCl concentration in slurry after neutralization with $Na_2S$ (moles/liter of slurry)—0

$Na_2S$—stoichiometric requirements for complete NaOCl neutralization (moles/liter of slurry)—0.005

$Na_2S$ used to neutralize NaOCl residual (moles/liter of slurry)—0.015

Multiple of stoichiometric amount of $Na_2S$ required to neutralize NaOCl residual—3.0

EXAMPLE 3

The same type ore as that used in Example 2 was also used in Example 3. The test procedure was the same with the exception that sodium hydrosulfide was used as the titrating solution. The strength of the titrating solution was 100 grams per liter NaHS. The test results were as follows:

Residual NaOCl concentration in slurry at completion of chlorination step (moles/liter of slurry)—0.020

Residual NaOCL concentration in slurry after neutralization with NaHS (moles/liter of slurry)—0

NaHS—stoichiometric requirements for complete NaOCl neutralization (moles/liter of slurry)—0.005

NaHS used to neutralize NaOCl residual—0.014

Multiple of stoichiometric amount of NaHS required to neutralize NaOCl residual—2.8

In the preceding three examples, the hypochlorite concentration was completely eliminated. These reactions required approximately two to three times the stoichiometric amount of $Na_2S$ or NaHS. Example 14 illustrates that the required amount of sulfide-providing compound added can be reduced to near the stoichiometric level if sulfide addition is stopped before the hypochlorite is completely eliminated. Considerable savings in sulfide compound costs can be achieved if it not necessary to completely eliminate all hypochlorite.

EXAMPLE 4

Two and one-half liters of slurry comprising 45% solids was prepared from carbonaceous gold ore ground to 95%-100 mesh. The raw ore was the same type as that used in Example 1.

The slurry was then chlorinated by the same general procedure described in Example 1 until a hypochlorite ion concentration of 0.020 moles per liter of slurry was achieved. A sample of the slurry weighing 352 grams was taken. The sample was then titrated with a 3.5 grams per liter solution of NaHS while simultaneously monitoring the oxidation potential of the slurry sample. The titration was stopped when the hypochlorite ion concentration had reached 0.00019 moles per liter of slurry. A summation of the test results follows:

Residual NaOCl concentration in slurry at completion of chlorination step (moles/liter of slurry)—0.020

Residual NaOCl concentration in slurry after neutralization with NaHS (mole/liter of slurry)—0.00019

NaHS—stoichiometric requirements for complete NaOCl neutralization (moles/liter of slurry)—0.0050

Actual amount of NaHS used to neutralize NaOCl residual (moles/liter of slurry)—0.0053

Multiple of stoichiometric amount of NaHS required to neutralize NaOCl residual—1.06

In describing the preferred embodiment of the invention specific terminology is used for the sake of clarity. However, it is not intended that the invention be limited to the specific terms so selected and it is to be understood that each specific term includes all technical equivalents which operate in a similar manner to accomplish a similar purpose. While certain preferred embodiments of the present invention have been disclosed in detail, it is to be understood that various modifications can be adopted without departing from the spirit of the invention or the scope of the following claims.

What is claimed is:

1. A method for extracting precious metal from a precious metal-containing carbonaceous ore or a mixture of precious metal-containing carbonaceous and oxide ores comprising:

(a) chlorinating said ore in an aqueous slurry with a compound that provides hypochlorite ions;

(b) reacting said hypochlorite ions in said aqueous slurry with sulfide ions from a soluble, sulfide ion-providing compound to eliminate said hypochlorite ions remaining in said aqueous slurry; and (c) leaching said hypochlorite ion-free slurry with a cyanide compound to separate said precious metal from said precious metal-containing carbonaceous ore or said mixture of precious metal-containing carbonaceous and oxide ores.

2. A method according to claim 1 additionally comprising a step of agitating said chlorinated slurry containing said sulfide ion-providing compound.

3. A method according to claim 1 additionally comprising a step of heating said chlorinated slurry containing said sulfide ion-providing compound.

4. A method according to claim 1 wherein said sulfide ion-providing compound is an inorganic compound.

5. A method according to claim 1 wherein the sulfide ion-providing compound is NaHS.

6. A method according to claim 1 wherein the sulfide ion-providing compound is $Na_2S$.

7. A method according to claim 1 wherein the sulfide ion-providing compound is $H_2S$.

8. A method according to claim 1 wherein said reacting is performed in a pH range from 5 to 10.

9. A method according to claim 1 wherein said reacting is performed in a pH range from 5 to 7.

10. A method according to claim 1 wherein said sulfide ion-providing compound is added to said chlorinated slurry in an amount from at least 1 time to 3 times a stoichiometric amount of said sulfide ion-providing compound required to react with said residual hypochlorite ions contained by said slurry.

11. A method of gold extraction from a gold-containing carbonaceous ore or a mixture of gold-containing carbonaceous and oxide ores comprising:

(a) crushingg said ore into a fine fraction;

(b) slurrying said fine fraction of said ore in an aqueous solution;

(c) chlorinating said ore in said aqueous solution with a compound that provides hypochlorite ions;

(d) reacting said hypochlorite ions in said aqueous solution with sulfide ions from a soluble, sulfide ion-providing compound to eliminate said hypochlorite ions remaining in said aqueous solution;

(e) leaching said hypochlorite ion-free slurry with a cyanide compound to separate gold from said gold-containing carbonaceous ore or said mixture of gold-containing carbonaceous and oxide ores.

12. Method as claimed in claim 11 wherein said sulfide ion-providing compound is an inorganic compound.

13. The method of claim 12 wherein the sulfide ion-providing compound is NaHS.

14. The method of claim 12 wherein the sulfide ion-providing compound is $Na_2S$.

15. The method of claim 12 wherein the sulfide ion-providing compound is $H_2S$.

16. A method according to claim 11 wherein said reacting is performed in a pH range from 5 to 10.

17. A method according to claim 11 wherein said reacting is performed in a pH range from 5 to 7.

18. A method according to claim 11 wherein said sulfide ion-providing compound is added to said chlorinated slurry in an amount from at least 1 time to 3 times a stoichiometric amount of said sulfide ion-providing compound required to react with said residual hypochlorite ions contained by said slurry.

* * * * *